US006158455A

United States Patent [19]

Marshall et al.

[11] Patent Number: 6,158,455

[45] Date of Patent: Dec. 12, 2000

[54] ANTIFREEZE CAP FOR FAUCET

[76] Inventors: William H. Marshall, 305 Mayerling, Houston, Tex. 77024; Robert E. Williams, 1223 Sundrop Ct., Chula Vista, Calif. 91911

[21] Appl. No.: 09/130,251

[22] Filed: Aug. 6, 1998

[51] Int. Cl.[7] ..... E03B 7/12; F16K 24/00; F16L 55/07

[52] U.S. Cl. ..... 137/59; 137/301; 137/550; 137/800; 137/801; 138/32; 138/41; 138/43; 138/46; 210/429; 210/432; 210/449; 251/121; 251/125

[58] Field of Search ..... 251/125, 121; 137/301, 59, 60, 55, 127, 801; 237/80; 138/32, 34, 96 T, 44, 41, 43, 46; 210/429, 432, 449, 453, 454

[56] References Cited

U.S. PATENT DOCUMENTS

| | | | |
|---|---|---|---|
| 608,243 | 8/1898 | Winkley | 184/93 |
| 1,139,331 | 5/1915 | Boulard | 210/432 |
| 2,650,180 | 8/1953 | Walker | 137/375 |
| 2,686,530 | 8/1954 | Dire | 137/375 |
| 2,768,766 | 10/1956 | Woebbeking | 220/323 |
| 2,932,313 | 4/1960 | Noland | 137/339 |
| 2,985,552 | 5/1961 | Watanabe | 137/375 |
| 3,446,226 | 5/1969 | Canterbury | 137/62 |
| 3,858,632 | 1/1975 | Stout | 137/375 |
| 4,071,043 | 1/1978 | Carlson | 137/375 |
| 4,103,701 | 8/1978 | Jeng | 137/375 |
| 4,142,565 | 3/1979 | Plunkett, Sr. | 137/375 |
| 4,380,245 | 4/1983 | Hefner | 137/375 |
| 4,700,732 | 10/1987 | Francisco | 137/107 |
| 4,993,450 | 2/1991 | Dunn | 137/382 |
| 5,287,874 | 2/1994 | Dixon et al. | 137/382 |
| 5,649,437 | 7/1997 | Royka, Jr. et al. | 70/164 |
| 5,715,855 | 2/1998 | Bennett | 137/60 |

OTHER PUBLICATIONS

"No Freeze® The Automatic Pipe Protector", Polar Industries, Inc. publication.

*Primary Examiner*—George L. Walton
*Attorney, Agent, or Firm*—Akin, Gump, Strauss, Hauer & Feld, L.L.P.

[57] ABSTRACT

A cap assembly for providing continuous drip to a faucet exposed to freezing temperatures such as a faucet located outside a house. The cap assembly includes a cap member adapted to be mounted over the end of a faucet, which cap member includes a cylindrical wall portion and a closed end portion having an opening therein. The cap assembly includes an internal annular ridge which is adapted to receive a flow disc within the ridge, which flow disc includes an opening which is non-aligned with the opening in the closed end portion of the cap in order to create a dripping action. A rubber washer is positioned in sealing engagement with the internal annular ridge and the flow disc. A filter member is located within the rubber washer such that, upon mounting of the cap assembly over the end portion of a faucet, a continuous dripping flow through the cap assembly may be provided in order to prevent water within the faucet or within piping leading to the faucet from freezing.

12 Claims, 1 Drawing Sheet

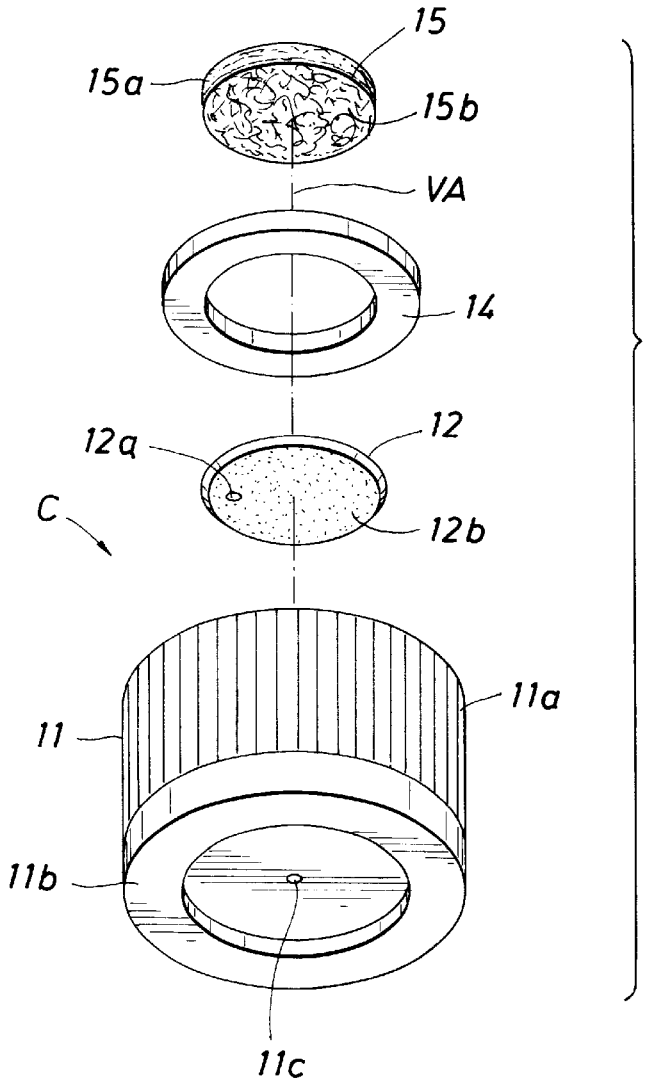
FIG. 1
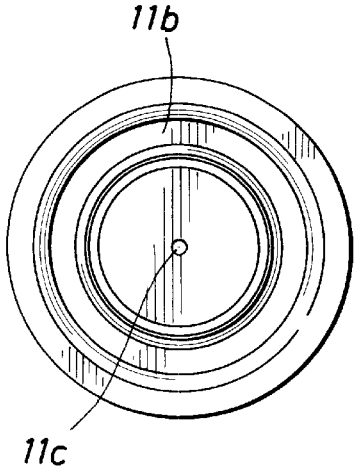
FIG. 3
FIG. 2
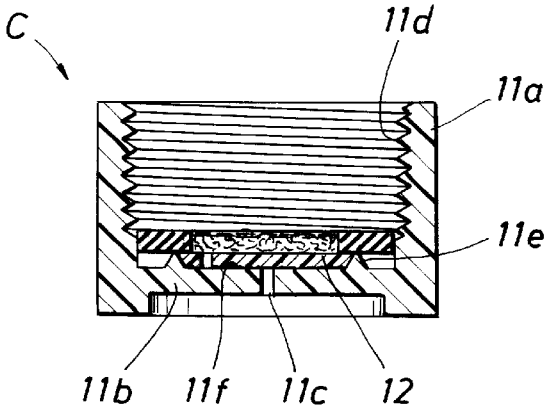

ANTIFREEZE CAP FOR FAUCET

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention relates to a device for preventing or minimizing freezing of water within a faucet by providing for continuous dripping of the faucet during freezing weather.

2. Description of the Related Art

In certain parts of the United States, particularly where homes are not built to withstand continuous freezing weather, many of the faucets located outside the walls of homes are susceptible to freezing because the faucets are attached to internal piping which runs through the outside walls with only the exterior veneer or brick protecting the internal piping. A period of continuous freezing weather can cause the water within the faucet and/or within the piping mounted inside the house wall to become frozen and burst, thus causing substantial damages. Sometimes the faucet is attached to piping that extends not only within an outside wall but also through the attic such that the piping can be subject to freezing within the attic as well as within the outside wall.

This has been a problem for many years and various methods and products have been used to try to solve the problem. For example, in the 1950s Delmar Products Company of Houston developed a faucet or hydrant dripper which included a valve which automatically opened upon weather conditions approaching freezing and closed upon rise in the temperature. While the idea of providing for continuous dripping of the faucet was a good approach, this product required the use of a temperature sensitive valve, which was expensive and subject to operational failure. U.S. Pat. No. 4,204,698 of Polar Industries, Inc. also utilized the concept of initiating dripping during freezing weather; however, this device also used a thermostat to open a valve, which was an expensive solution and subject to operational failure. Insofar as known, neither of these products are currently on the market.

Another approach is found in a variety of patents which utilizes various insulated shields or containers to surround the faucet to prevent the water in the faucet from freezing. These insulating devices have, in some instances, been moderately successful. Because such shields only slow down the loss of heat from the faucet to the atmosphere but do not stop heat transfer during a prolonged cold spell, the faucet will eventually freeze. Further, insulated shields can be cumbersome to mount onto and take off of faucets when the faucets need to be used, and these devices do not deter freezing of water in the piping located in the outside wall or in the attic of the house.

SUMMARY OF THE INVENTION

It is the object of this invention to provide a simple cap assembly which can be easily mounted onto the outlet of a faucet to provide for continuous dripping during freezing weather. This cap assembly can be easily removed and reinstalled at virtually any time.

The cap assembly of this invention is adapted to be mounted onto the threaded outlet of a faucet in order to prevent freezing of water within the faucet, and includes a generally cylindrical cap having a first closed end portion and female threads located within the recess within the cap such that the cap can be easily screwed onto the outlet of a faucet. The first closed end portion of the cap includes an opening. A flow disc is mounted within the cap and has an opening which is positioned in nonalignment with the opening in the closed end portion of the cap in order to provide a limited flow liquid travel path when the cap assembly is installed onto the end of a faucet. An annular resilient seal member is mounted within the cap recess in sealing engagement with the flow disc and is adapted to sealingly engage the threaded outlet of the faucet when the cap assembly is installed so that a continuous drip of water from the faucet prevents freezing of water within the faucet, and within piping leading to the faucet.

BRIEF DESCRIPTION OF THE DRAWINGS

FIG. 1 is an exploded view of the components of the antifreeze cap assembly of this invention;

FIG. 2 is a sectional view of the assembled cap assembly; and

FIG. 3 is a bottom view of the cap assembly of this invention.

DETAILED DESCRIPTION OF INVENTION

Referring to the drawings, the letter C generally designates the faucet antifreeze cap assembly of the preferred embodiment of this invention. The faucet antifreeze cap assembly C includes a cap 11, which is formed by a generally cylindrical wall member 11*a* integrally formed with a closed end portion 11*b*. The closed end portion 11*b* has an opening 11*c* therein which is located at the center line or center point of the vertical axis (as shown in the drawings) VA of the cap 11. The cylindrical wall member 11*a* and closed end portion 11*b* cooperate to form an internal recess. The internal portion of the wall member 11*a* is threaded at 11*d* such that the cap 11 can be mounted over the external threaded portion of a typical faucet, such as a faucet that extends out of the outside wall of a house in a well-known manner. The closed end portion 11*b* of the cap includes an internal annular ridge portion 11*e* which has a nominal diameter equal to the nominal diameter of the outer end of the faucet. Such a cap is manufactured under the trademark Rainbird®, and is available at any hardware or other garden supply store that carry the Rainbird® line of equipment. The outside diameter of the hole 11*c* may be ⅛" inch or other suitable size as is necessary in order to enhance continuous dripping when the cap assembly C is installed on a faucet.

A flow disc 12 is generally circular in configuration and has an outside diameter which is less than the inside diameter of the internal annular ridge portion 11*e* of the cap 11 so that the flow disc can be mounted within the internal annular ridge portion against the inside surface 11*f* of the closed end portion 11*b* of the cap 11. The flow disc 12 may be made of polyethylene or any other suitable plastic. The flow disc has an opening 12*a* which is located offset from the center line VA of the cap assembly 11 such that the opening in the flow disc is not aligned with the opening 11*c* in the closed end portion 11*b* of the cap 11. The bottom surface 12*b* of the flow disc has a surface roughness similar to that obtained by abrading the surface with 400 grit sandpaper to enhance limited water flow through opening 12*a* in disc 12 and outwardly of opening 11*c* in the closed end portion 11*b* of the cap 11. Other suitable levels of roughness may obtain variation in flow. However, it has been determined that a roughness equivalent to 120 grit sandpaper is too rough (allowing too great a water flow) and a roughness equivalent to 1200 grit sandpaper is too fine (too great a reduction in flow).

The thickness of the flow disc 12 is equal to or slightly greater than the height of the internal annular ridge portion 11*e* so that the amount of dripping flow outwardly of the cap assembly can be adjusted, depending upon how tightly the cap assembly is screwed onto the end of the faucet.

An annular sealing member or rubber washer 14 is positioned in sealing engagement with the upper portion of the internal annual ridge 11*e* of the cap end portion 11 and in sealing engagement with the periphery of the flow disc 12 when the cap assembly is mounted onto the end of a faucet. The rubber washer is a typical garden hose type of rubber washer as is well-known in the art.

A generally circular filter member 15 is mounted inside of the rubber washer 14 and is provided to filter out large particulate from the water to prevent plugging up of the flow disc opening 12*a* or the opening 11*c* in the closed end portion 11*b* of the cap 11. The filter member 15 may be made of a disc 15*a* of felt fabric having a microporous membrane 15*b* located on one side thereof. The felt material 15*a* has larger openings or pores than the membrane 15*b* in order to stop the intrusion of any large particles and the bottom membrane 15*b* has smaller openings to prevent the intrusion of smaller particles.

In operation, the cap assembly 11 is mounted over the end of a faucet prior to or during freezing weather. It is understood that the faucet may be located outside or inside a home or other structure. The device of this invention is applicable to a faucet located anywhere, as well as to other valves where flow needs to be carefully controlled to prevent freezing. Further, the term "faucet" includes not only the actual valves, but also the pipe supplying water to the faucet. The cap assembly is screwed onto the faucet to a position of moderate tightness, and then the faucet valve is opened up completely. The cap assembly can then be screwed onto the faucet end tighter if necessary in order to adjust the position of the cap member such that the flow outwardly of the cap assembly is a continuous drip. As the cap assembly is screwed tighter on the faucet end, the end of the faucet bears with greater pressure against the rubber washer 14, which presses the flow disc 12 into greater engagement with the inside surface 11*f* of the closed end portion of the cap, thereby controlling the allowed dripping through the cap assembly. The continuous drip through the cap assembly C provides flow through the faucet as well as through the piping leading to the faucet to prevent freezing during cold weather. The continuous flow of water through the pipe and faucet carries heat from underground water supply to the faucet and carries away water that has been cooled to near freezing by exposure to the atmosphere. One important point is that a smooth and a rough surface be brought into intimate contact and a means provided to control the force pressing the two surfaces together, thereby controlling the size of the micro-conduits carrying the water.

The foregoing disclosure and description of the invention are illustrative and explanatory thereof, and various changes in the details of the illustrated apparatus and construction and method of operation may be made without departing from the spirit of the invention. For example, the number of openings in the closed end portion of the cap may be adjusted, as well as the size of the openings, and the number of openings in the flow disc assembly can be adjusted as necessary. Also, depending upon the type and size of particulate of the water, it may be necessary to modify the size of the openings in the felt fabric and/or membrane in the filter 15. Further, while the cap assembly is described as being attachable to a common faucet, the attachment structure of the cap member can be varied to attach the cap assembly to other types of valves. Further, the necessary surface roughness may be located on surface 11*f* rather than on the flow disc 12.

What is claimed is:

1. An antifreeze cap assembly adapted to be mounted on the threaded outlet of a faucet in order to prevent freezing of water within the faucet, comprising:

a cap adapted to be mounted over the threaded outlet of a faucet, said cap being generally cylindrical in configuration to form a generally cylindrical side wall and having a first substantially closed end portion such that said first substantially closed end portion and said generally cylindrical side wall form an internal recess said substantially closed end portion of said cap having an opening therein;

said substantially closed end portion having an interior surface and a flow disc mounted onto said interior surface of said substantially closed end portion, said flow disc having an opening therein;

an annular, resilient seal member mounted in said cap recess in sealing engagement with said flow disc, said annular seal member being adapted to receive said threaded outlet of the faucet for sealing engagement therebetween, whereby a continuous drip of water from the faucet outwardly of said antifreeze cap assembly prevents freezing of water within the faucet, said flow rate of said continuous drip being determined by the pressure of said threaded outlet of the faucet against said annular resilient seal member.

2. The structure set forth in claim 1, including:

a filter member mounted in said cap recess adjacent said annular, resilient seal member and said flow disc.

3. The structure set forth in claim 2, including:

said filter member having pores sized to prevent the passage of undesirable particulate.

4. The structure set forth in claim 3, further including:

said filter member including a first portion having pores of a first size range and a second portion having pores of a second size range, said first portion having a pore range of larger size than the pore range in said second portion.

5. The structure set forth in claim 1, including:

said interior surface of said first substantially closed end portion of said cap includes an annular ridge of substantially the same diameter as the end of the faucet.

6. The structure set forth in claim 5, including:

said flow disc being circular in configuration and having a diameter less than the diameter of said annular ridge such that said flow disc is mounted substantially within said annular ridge of said cap.

7. The structure set forth in claim 5, including:

said annulus resilient seal member is mounted for sealing engagement with the end of the threaded outlet of the faucet and in sealing engagement with said internal annular ridge of said cap.

8. The structure set forth in claim 1, including:

said opening in said flow disc being non-aligned with said opening in said substantially closed end portion of said cap.

9. The structure of claim 1, including:

said generally cylindrical side wall having an interior threaded portion within said internal recess for threaded engagement with the threaded outlet of the faucet.

10. The structure set forth in claim 1, wherein:

said opening in said substantially closed end portion of said cap is formed at about the center thereof.

11. The structure set forth in claim 10, including:

said opening in said flow disc being positioned offset from the center of said flow disc in a position of non-alignment with said opening in said substantially closed end portion of said cap.

12. The structure set forth in claim 1, including:

said flow disc having a bottom surface located adjacent to said first substantially closed end portion of said cap, which bottom surface is roughened to control limited flow through said opening in said flow disc, between said flow disc and said substantially closed end portion, and outwardly of said substantially closed end portion of said cap.

* * * * *